US012643027B1

(12) United States Patent
Gordon

(10) Patent No.: US 12,643,027 B1
(45) Date of Patent: Jun. 2, 2026

(54) PUTTING GAME APPARATUSES

(71) Applicant: Joseph Gordon, Redmond, OR (US)

(72) Inventor: Joseph Gordon, Redmond, OR (US)

( * ) Notice: Subject to any disclaimer, the term of this patent is extended or adjusted under 35 U.S.C. 154(b) by 322 days.

(21) Appl. No.: 18/617,480

(22) Filed: Mar. 26, 2024

(51) Int. Cl.
*A63B 67/02* (2006.01)

(52) U.S. Cl.
CPC ..... *A63B 67/02* (2013.01); *A63B 2210/50* (2013.01)

(58) Field of Classification Search
CPC ..... A63B 67/02; A63B 69/36
See application file for complete search history.

(56) References Cited

U.S. PATENT DOCUMENTS 3,424,463 A * 1/1969 Matthews ..... A63B 67/02 273/125 R
4,634,130 A * 1/1987 Simjian ..... A63B 57/357 273/DIG. 26
4,828,267 A * 5/1989 Goodrich ..... A63B 47/00 473/160
5,197,738 A * 3/1993 Hartman, Sr. ..... A63B 67/02 473/158
2014/0309052 A1* 10/2014 Ligrow ..... G09B 19/0038 473/278

* cited by examiner

*Primary Examiner* — Michael D Dennis
(74) *Attorney, Agent, or Firm* — Mohr Intellectual Property Law Solutions, PC

(57) ABSTRACT

Putting game apparatuses including a case and a ramp. The case includes a first frame, a second frame, and a planar member. The first frame includes a first floor, first sidewalls, and a scoring tray. The scoring tray is spaced above the first floor. The scoring tray defines an array of scoring holes complementarily configured with a golf ball. The second frame is connected to the first frame. The second frame includes a second floor, second sidewalls, and a scatter field. The scatter field includes a plurality of scatter members extending from the second floor. The planar member includes a putting surface facing away from the second frame and defines a target hole extending through the planar member. The ramp is selectively disposed over the first frame. The ramp defines a tee shot path onto the putting surface of the planar member.

20 Claims, 8 Drawing Sheets

PUTTING GAME APPARATUSES

BACKGROUND

The present disclosure relates generally to golf games. In particular, putting game apparatuses are described.

Miniature golf is loved by millions of people as a game that provides a fun time without requiring the skill level of regular golf. Whereas regular golf involves multiple golf clubs and hitting a golf ball long distances, miniature golf requires only a putter and focuses on putting a golf ball relatively short distances. Miniature golf also typically introduces obstacles and other novelties to make playing the game more interesting and exciting.

Typically, miniature golf is played at a dedicated miniature golf facility. Often an admission fee is required to play miniature golf at a dedicated facility. Miniature golf facilities can be quite popular, and demand for access to the facilities can exceed their capacity. When miniature golf facilities are operating at their capacity limit, customers may have to wait to start playing and moving through the miniature golf course may be slow.

People would enjoy the opportunity to play miniature golf games at home, outdoors, at restaurants or bars, and at other social gathering spots rather than only at dedicated miniature golf facilities. It would be desirable to have a putting game apparatus that enabled playing miniature golf games at home or other desired locations. It would be beneficial if the putting game apparatus was fun, competitive, and entertaining. Ideally, the putting game apparatus would be compact, self-contained, portable, and easily stored.

Thus, there exists a need for putting game apparatuses that enable new and convenient opportunities to play miniature golf games beyond dedicated miniature golf facilities. Examples of new and useful putting game apparatuses relevant to the needs existing in the field are discussed below.

SUMMARY

The present disclosure is directed to putting game apparatuses including a case and a ramp. The case includes a first frame, a second frame, and a planar member. The first frame includes a first floor, first sidewalls, and a scoring tray. The scoring tray is spaced above the first floor. The scoring tray defines an array of scoring holes complementarily configured with a golf ball. The second frame is connected to the first frame. The second frame includes a second floor, second sidewalls, and a scatter field. The scatter field includes a plurality of scatter members extending from the second floor. The planar member includes a putting surface facing away from the second frame and defines a target hole extending through the planar member. The ramp is selectively disposed over the first frame. The ramp defines a tee shot path onto the putting surface of the planar member.

DETAILED DESCRIPTION

Figure 1:
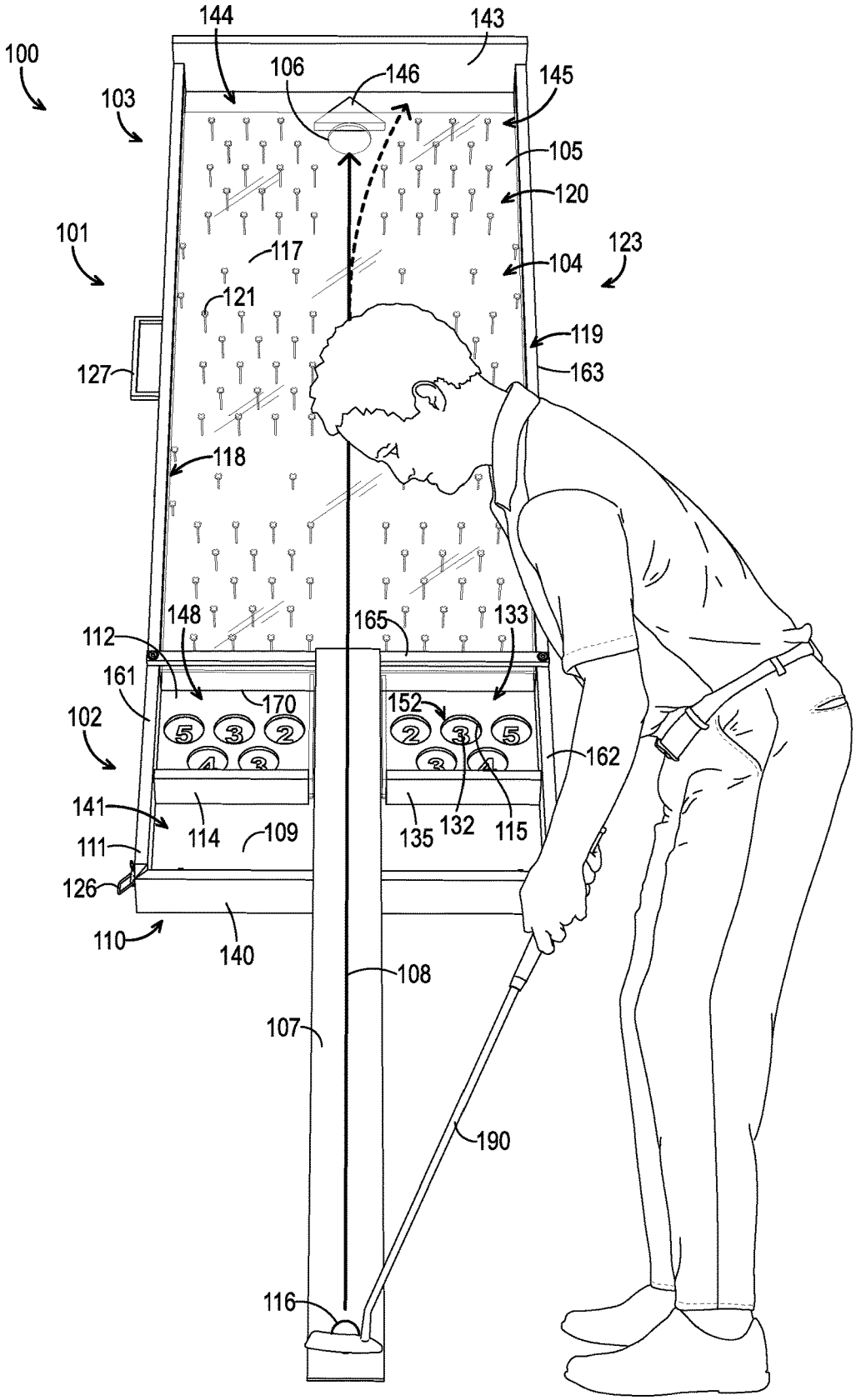
FIG. 1 is a view of a person using a putting game apparatus.

The disclosed putting game apparatuses will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various putting game apparatuses are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Putting Game Apparatuses

With reference to the figures, putting game apparatuses will now be described. The putting game apparatuses discussed herein function to provide miniature golf gameplay experiences. The putting game apparatuses are transportable and enable a user to play miniature golf putting games at various desired locations.

The reader will appreciate from the figures and description below that the presently disclosed putting game apparatuses address current needs related to miniature golf and other putting games. For example, the novel putting game apparatuses described herein enable new and convenient opportunities to play miniature golf games beyond dedicated miniature golf facilities. As a result, the novel putting game apparatuses allow people to avoid the drawbacks of dedicated miniature golf facilities, including admission fees and overcrowding. The novel putting game apparatuses allow people to play miniature golf and other putting games at their own pace and without interference from other parties.

Notably, the novel putting game apparatuses discussed in this document create opportunities to play miniature golf games at home, outdoors, at restaurants or bars, and at other social gathering spots. Desirably, the novel putting game apparatuses provide fun, competitive, and entertaining gameplay for people with a wide range of golf abilities. It is not necessary for someone to have regular golf skills to enjoy putting games facilitated by the novel putting game apparatuses discussed herein. Beneficially, the novel putting game apparatuses discussed below are compact, self-contained, portable, and easily stored.

Contextual Details

Ancillary features relevant to the putting game apparatuses described herein will first be described to provide context and to aid discussing the putting game apparatuses.

Ancillary Gameplay Equipment

The putting game apparatuses in this document are typically used to play putting games with selected, standard golf equipment; namely, a putter and a golf ball. For example, as shown in FIG. 1, a user is using a putter 190 to put a golf ball 116 onto a putting game apparatus 100. However, a putter and a golf ball are just examples of anicillary gameplay equipment that may be used with the game apparatuses descried herein.

The reader should understand that the putting game apparatuses described herein may be used for games beyond miniature golf or other putting-related games. Designating the game apparatuses described herein as putting game apparatuses is merely for convenience because putting games is one of the more popular game types the game apparatuses support.

When the game apparatuses are considered more generally, the reader will understand that it is not necessary that a putter or golf ball be used with the game apparatuses. For example, the game apparatuses could be used with a ball other than a golf ball, such as a tennis ball, a billiard ball, and the like. Rather than using a putter, one could roll the ball onto the game apparatus by hand, kick the ball onto the game apparatus by foot, or use another object, such as a pool cue or croquet mallet, to direct the ball towards to the game apparatus.

In the putting game application of game apparatus 100, putter 190 and golf ball 116 depicted in FIG. 1 are just examples of suitable putters and golf balls. Any suitable size, shape, and type of putter and golf ball may be used. In some examples, putters and golf balls are included components of the putting game apparatus, and, in other examples, putters and golf balls are supplied by the user of the putting game apparatus.

The number of golf balls and putters used with or included in the putting game apparatuses herein may be selected to meet the needs of a given gameplay method. The reader should appreciate that the number of golf balls and putters may be different in other examples than is shown in the figures. For instance, some putting game apparatus examples include more golf balls and/or putters than described in examples shown in the figures.

Game Apparatus Embodiment One

With reference to FIGS. 1-8, a game apparatus 100 will now be described as a first example of a game apparatus. Game apparatus 100 serves to support a variety of games and gameplay methods, including putting-based games and gameplay. For simplicity and to highlight a concrete example, the present disclosure will focus on putting games and refer to game apparatus as a putting game apparatus. However, the reader should understand that the game apparatuses described herein may be used for many games beyond putting or golf-related games.

Putting game apparatus 100 is configured to be portable and easily transported to different desired locations. Comparing FIGS. 1-4 with FIGS. 5-7, the reader can see that putting game apparatus 100 is configured to selectively change configurations to facilitate transporting, using, and storing it. For example, FIGS. 1-4 depict putting game apparatus 100 in a play configuration 123 where a user may use putting game apparatus 100 to play a putting game.

Figure 5:
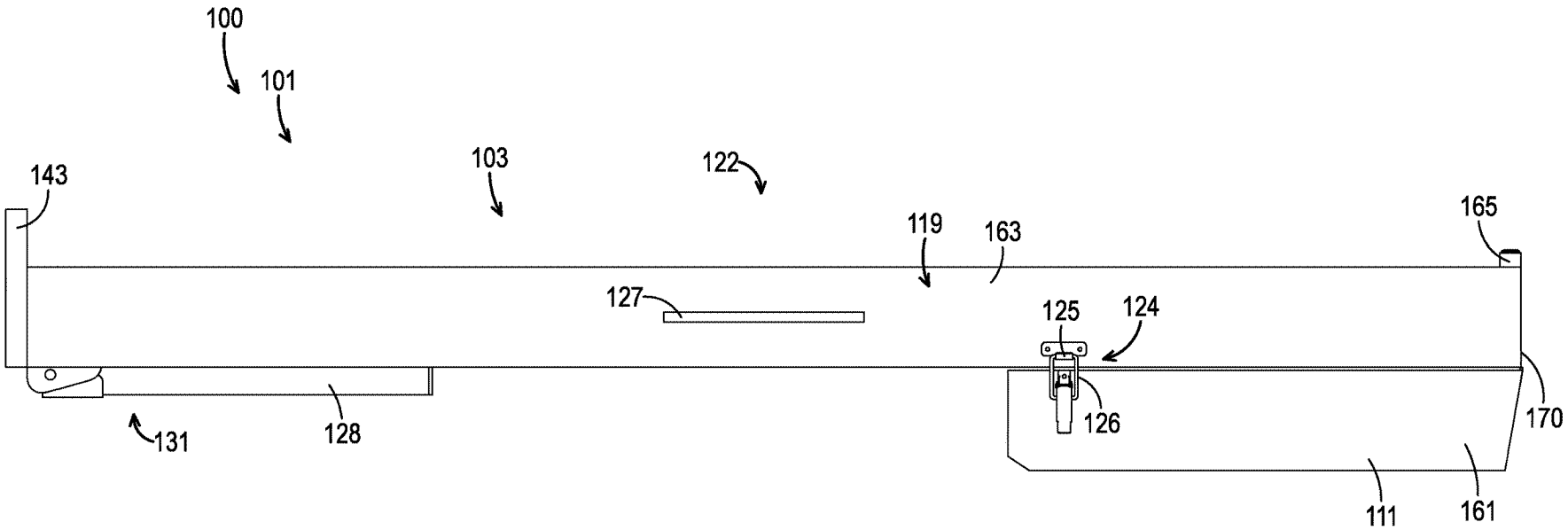
FIG. 5 is a side elevation view of the putting game apparatus shown in FIG. 1 in a stowed configuration.
Figure 6:
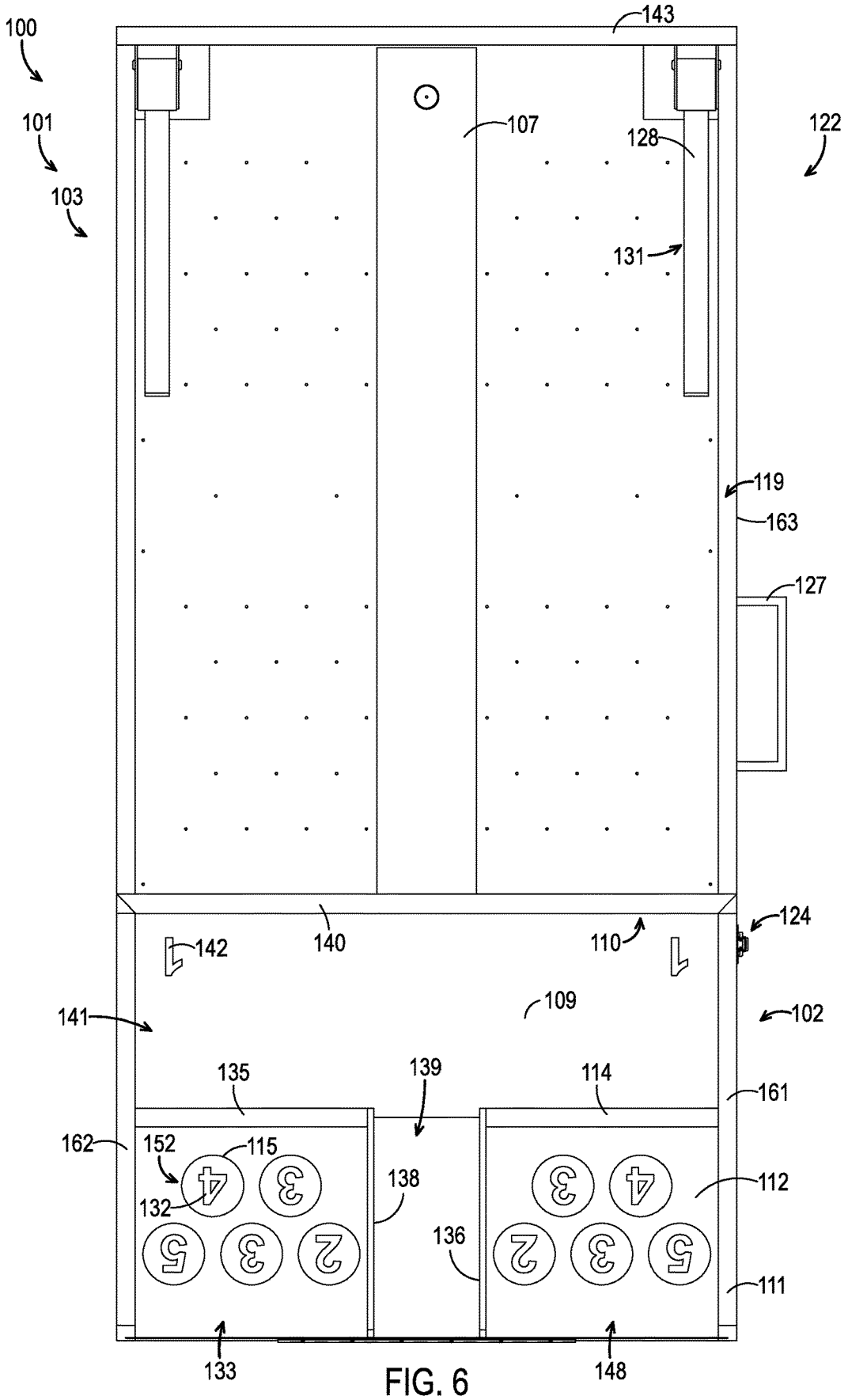
FIG. 6 is a bottom plan view of the putting game apparatus shown in FIG. 1 in the stowed configuration.
Figure 7:
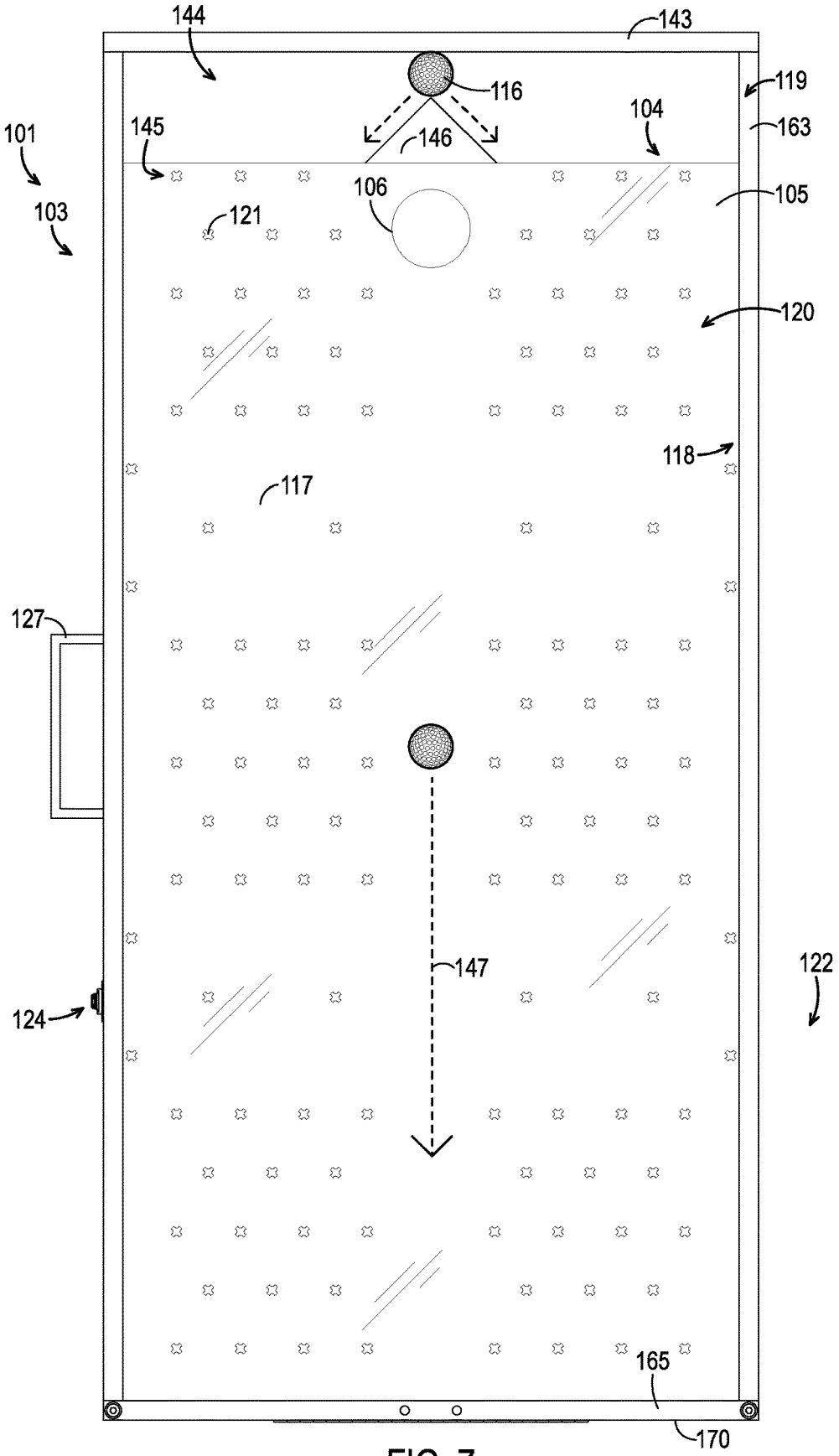
FIG. 7 is a top plan view of a second frame of the putting game apparatus with arrows representing paths the golf ball may follow in the second frame when diverted by a diverted.

In contrast, in FIGS. 5-7, putting game apparatus 100 is depicted in a stowed configuration 122. Putting game apparatus 100 can be readily transported or stored away in stowed configuration 122.

As shown in FIGS. 1-8, putting game apparatus 100 includes a case 101, a ramp 107, a latch assembly 124, and legs 128. The case, ramp, latch assembly, and leg components are discussed below.

The size and shape of the putting game apparatus may be varied as needed for a given application. In some examples, the putting game apparatus is larger or smaller relative to the other components than depicted in the figures.

Case

The role of case 101 is to structurally support putting game apparatus 100. Further, case 101 presents users with a variety of game elements to enable various putting gameplay methods. Moreover, case 101 enables changing the configuration of putting game apparatus 100 to facilitate transporting, using, and storing putting game apparatus 100.

With reference to FIGS. 1-8, case 101 is configured to pivot between stowed configuration 122 and play configuration 123. FIGS. 1-4 depict case 101 in play configuration 123. In play configuration 123, a user may use putting game apparatus 100 to play a putting game.

In FIGS. 5-7, case 101 is depicted in stowed configuration 122. Putting game apparatus 100 can be readily transported or stored away in stowed configuration 122.

As depicted in FIGS. 1-8, case 101 includes a first frame 102, a second frame 103, and a planar member 104. The frame and planar member components are discussed below.

The size and shape of the case may be varied as needed for a given application. In some examples, the case is larger or smaller relative to the other components than depicted in the figures.

Frames

The frames cooperate to selectively transform the configuration of putting game apparatus 100 to be conducive to playing putting games and to transporting or stowing putting game apparatus 100. Further, the frames cooperate with each other, planar member 104, and ramp 107 to enable putting gameplay methods. FIG. 1 depicts one gameplay method enabled by putting game apparatus 100.

In general, the goal of the gameplay method depicted in FIG. 1 is to score the minimum number of points resulting from putting golf ball 116 into case 101. Points are scored or incurred by putting golf ball 116 into scoring regions defined in first frame 102. The game may be played over multiple rounds, such as 9 or 18 rounds corresponding to the typical numbers of holes in traditional golf.

Points from successful putts are attributed based on where golf ball 116 comes to rest within first frame 102. First frame 102 defines multiple scoring regions; namely, scoring wells 152 and catch basin 141. Golf ball 116 comes to rest in a given scoring well 152 or in catch basin 141 after first being putted up ramp 107 and into second frame 103 via different openings, target hole 106 or entrance gap 144, defined in second frame 103.

FIG. 1 depicts two possible initial outcomes of putting golf ball 116 with putting game apparatus 100. As shown in FIG. 1, golf ball 116 may first travel up ramp 107, over planar member 104, and through either target hole 106 or entrance gap 144 defined in planar member 104 to enter second frame 103.

A third potential outcome of putting golf ball 116 is that golf ball 116 fails to reach either target hole 106 or entrance gap 144. Golf ball 116 may fail to reach target hole 106 and entrance gap 144 because the user did not putt golf ball 116 with sufficient force to make it fully up the incline in which planar member 104 is oriented. Additionally or alternatively, the putt may cause golf ball 116 to fall off either lateral side of ramp 107. The reader can appreciate that skill is required to putt golf ball 116 straight up ramp 107, which can increase the fun, challenge, and excitement of putting games on putting game apparatus 100.

When a user's putt causes golf ball 116 to fail to reach one of the scoring regions defined in first frame 102, the gameplay method may assign a penalty of one stroke and require the user to attempt a successful putt again. Once the user makes a successful putt into a scoring region, penalty strokes incurred from unsuccessful putt attempts that round may be added to the score resulting from golf ball 116 coming to rest in a given scoring well 152 or in catch basin 141.

The reader can see in FIGS. 2 and 4-6 that first frame 102 is pivotally coupled to second frame 103. As shown in FIGS. 1-4 and 8, first frame 102 pivots to a position adjacent to second frame 103 in play configuration 123. With reference to FIGS. 5 and 6, first frame 102 pivots to a compact position underlying second frame 103 in stowed configuration 122.

The number of frames in the putting game apparatus may be selected to meet the needs of a given application. The reader should appreciate that the number of frames may be different in other examples than is shown in the figures. For instance, some putting game apparatus examples include additional or fewer frames than described in the present example.

In the present example, the frames are composed predominately of wood. However, the frames may be composed of any currently known or later developed material suitable for frame applications. Suitable materials include metals, polymers, ceramics, wood, and composite materials.

The size and shape of the frames may be varied as needed for a given application. In some examples, the frames are larger or smaller relative to the other components than depicted in the figures.

First Frame

First frame 102 functions to catch golf ball 116 after golf ball 116 passes through second frame 103. In addition to catching golf ball 116, first frame 102 serves to define scoring regions associated with different locations where golf ball 116 comes to rest in first frame 102. The different scoring regions are defined by components of first frame 102; namely, with reference to FIGS. 1-3, 6, and 8 and discussed below, a first floor 109, first sidewalls 111, and a scoring tray 112.

First frame 102 includes first floor 109, first sidewalls 111, a bottom sidewall 140, a first lower wall 114, a second lower wall 135, a scoring tray 112, a first barrier wall 136, and a second barrier wall 138. The components of first frame 102 are described below.

Walls of First Frame

As shown in FIGS. 1-8, first frame 102 includes a variety of walls. In particular, first frame includes sidewalls, lower walls, and barrier walls. The different types of walls are described further below.

The sidewalls, lower walls, and barrier walls may be any currently known or later developed type of wall. Various wall types exist and could be used in place of the walls shown in the figures. In addition to the types of walls existing currently, it is contemplated that the putting game apparatuses described herein could incorporate new types of walls developed in the future.

The number of walls in the putting game apparatus may be selected to meet the needs of a given application. The reader should appreciate that the number of walls may be different in other examples than is shown in the figures. For instance, some putting game apparatus examples include additional or fewer walls than described in the present example.

The size and shape of the walls may be varied as needed for a given application. In some examples, the walls are larger or smaller relative to the other components than depicted in the figures.

First Sidewalls

With reference to FIGS. 1-3, 6, and 8, the reader can see that first floor 109 includes a first periphery 110. As shown in FIGS. 1-3, 6, and 8, first sidewalls 111 extend vertically from first periphery 110. First sidewalls 111 and first floor 109 function to contain golf ball 116 within first frame 102.

First sidewalls 111 include a first lateral sidewall 161, a second lateral sidewall 162, and a bottom sidewall 140. Second lateral sidewall 162 is on an opposite lateral side of first floor 109 than first lateral sidewall 161. First lateral sidewall 161 and second lateral sidewall 162 function to laterally bound first frame 102 on opposite lateral sides of first floor 109. Bottom sidewall 140 extends between first lateral sidewall 161 and second lateral sidewall 162.

Lower Walls

As shown in in FIGS. 1-3, 6, and 8, first lower wall 114 and second lower wall 135 are disposed between bottom sidewall 140 and second frame 103. Expressed another way, first lower wall 114 and second lower wall 135 are longitudinally spaced from bottom sidewall 140. As depicted in FIGS. 1-3, 6, and 8, catch basin 141 is defined in the space between bottom sidewall 140 and first lower wall 114 and second lower wall 135.

Figure 8:
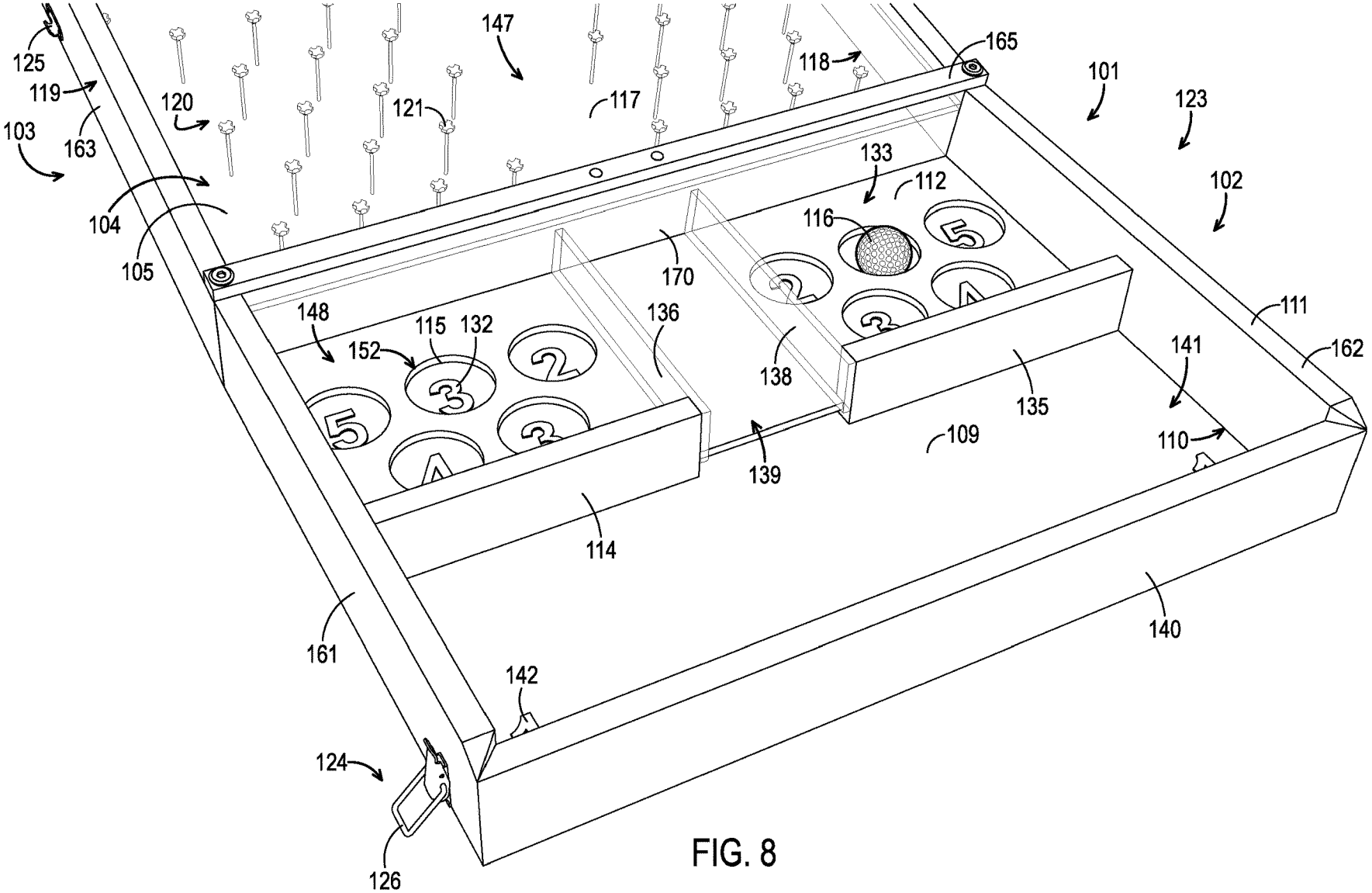
FIG. 8 is a perspective view of a first frame of the putting game apparatus with a golf ball disposed in a scoring hole.

With reference to FIG. 8, the reader can see that first lower wall 114 extends transverse from first lateral sidewall 161. Similarly, second lower wall 135 extends transverse from second lateral sidewall 134. First lower wall 114 supports scoring tray 112 and forms a lower boundary of first scoring region 148. Second lower wall 135 forms a lower boundary of second scoring region 133 and also supports scoring tray 112.

Barrier Walls

The barrier walls serve to separate the scoring regions from a ball channel 139 extending along the median of first frame 102. As shown in FIG. 8, first barrier wall 136 extends longitudinally along first frame 102 from first lower wall 114. As further shown in FIG. 8, first barrier wall 136 separates first scoring region 148 from the median of first frame 102. As depicted in FIGS. 1, 3, 6, and 8, second barrier wall 138 is laterally spaced from first barrier wall 136 to define a ball channel 139 between them.

Second barrier wall 138 is configured the same as first barrier wall 136 and oriented similarly. As can be seen in FIG. 8, second barrier wall 138 extends longitudinally from second lower wall 135. Second barrier wall 138 separates second scoring region 133 from the median of first frame 102. Further, second barrier wall 138 separates second scoring region 133 from ball channel 139 extending along the median of first frame 102.

The reader can see in FIG. 8 that ball channel 139 communicates with target hole path 147 on a top end of ball channel 139. A bottom end of ball channel 139 communicates with catch basin 141. Thus, ball channel 139 provides a path between target hole path 147 and catch basin 141 to yield the lowest (most preferred) points for a round.

The size and shape of the ball channel may be varied as needed for a given application. In some examples, the ball channel is larger or smaller relative to the other components than depicted in the figures.

The number of ball channels in the putting game apparatus may be selected to meet the needs of a given application. The reader should appreciate that the number of ball channels may be different in other examples than is shown in the figures. For instance, some putting game apparatus examples include additional or fewer ball channels than described in the present example.

Scoring Tray

Scoring tray 112 is supported by first lower wall 114, second lower wall 135, first lateral sidewall 161, and second lateral sidewall 162. The reader can see in FIG. 8 that scoring tray 112 is spaced above first floor 109. With reference to FIG. 8, scoring tray 112 is spaced from first floor 109 a distance less than the height of a golf ball 116. Scoring tray 112 being spaced from first floor 109 a distance less than the height of golf ball 116 allows scoring tray 112 to retain golf ball 116 within a given scoring hole when golf ball 116 enters the given scoring hole.

As depicted in FIGS. 1-3, 6, and 8, scoring tray 112 defines an array of scoring holes 115 complementarily configured with a golf ball 116. Further, as depicted in FIGS. 1-3, 6, and 8, first floor 109 and scoring tray 112 cooperate to define scoring wells 152 in which golf ball 116 may come to rest. As shown in FIG. 8, scoring wells 152 are defined by a scoring hole 115 opening defined in scoring tray 112 and first floor 109 below scoring hole 115. First floor 109 supports golf ball 116 from below and scoring tray 112 laterally supports and retains golf ball 116 within scoring well 152.

Figure 3:
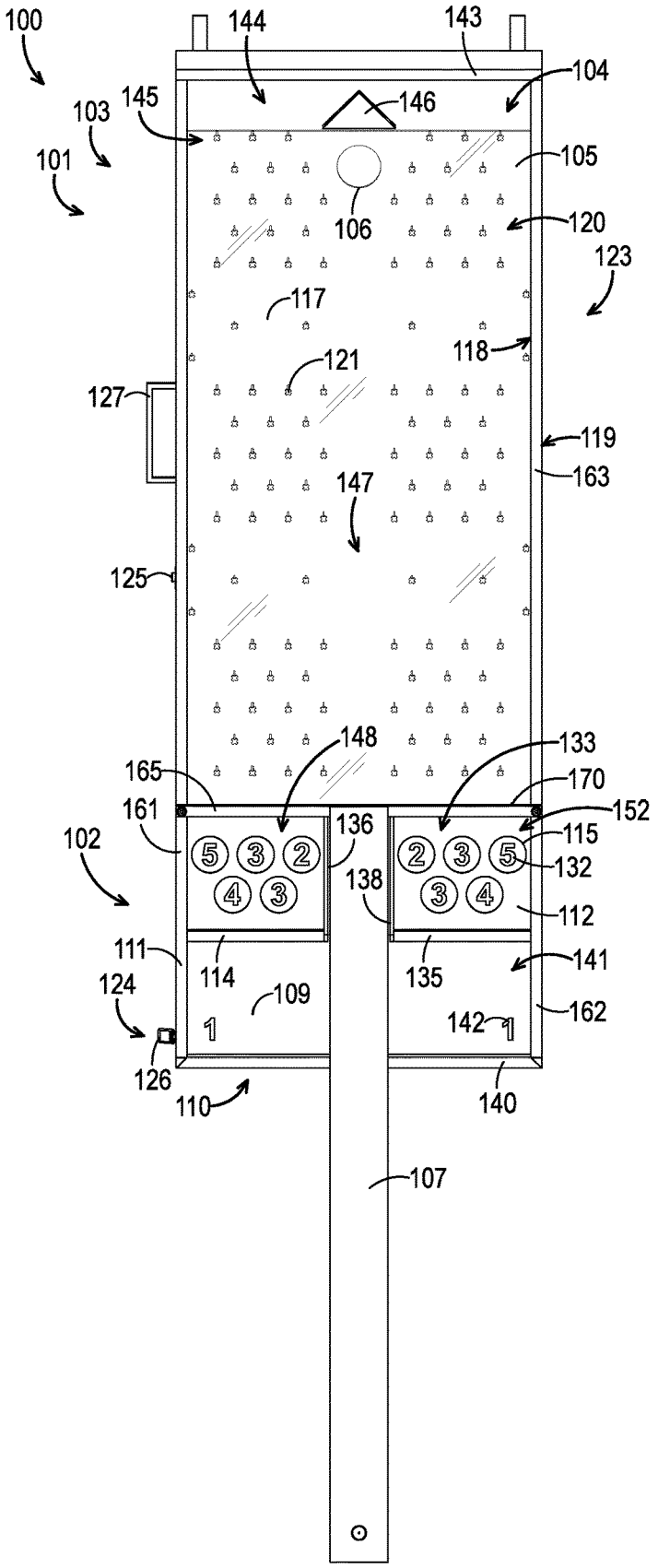
FIG. 3 is a top plan view of the putting game apparatus shown in FIG. 1

Scoring wells 152 define some of the different scoring regions of first frame 102 while catch basin 141 defines an additional scoring region. As shown in FIGS. 3, 6, and 8, first floor 109 includes a scoring hole points indicator 132 underneath each scoring hole 115 in the array of scoring holes defined by scoring tray 112. Scoring hole points indicators 132 designate gameplay points associated with golf ball 116 resting within a given scoring hole.

As shown in FIGS. 1-3, 6, and 8, scoring tray 112 includes first scoring region 148 and second scoring region 133. However, the reader should appreciate that the number of scoring regions may be different in other examples than is shown in the figures. For instance, some putting game apparatus examples include additional or fewer scoring regions than described in the present example.

As depicted in FIGS. 1-3, 6, and 8, first scoring region 148 is laterally bounded by first barrier wall 136 and first lateral sidewall 161. First scoring region 148 is bounded on a bottom side by first lower wall 114.

Second scoring region 133 is laterally spaced from first scoring region 148. As shown in FIG. 8, a ball channel 139 is disposed between first scoring region 148 and second scoring region 133. Ball channel 139 extends along the median of first frame 102.

As shown in FIGS. 1-3, 6, and 8, second scoring region 133 is adjacent to a second lateral sidewall 162 of first sidewalls 111 opposite first lateral sidewall 161. Further, second scoring region 133 is adjacent to a second lower wall 135. The reader can see in FIGS. 1, 3, 6, and 8 that second scoring region 133 is laterally bounded by second barrier wall 138.

The size and shape of the scoring regions may be varied as needed for a given application. In some examples, the scoring regions are larger or smaller relative to the other components than depicted in the figures.

As shown in FIGS. 1-3, 6, and 8, the scoring regions of scoring tray 112 each define a plurality of scoring holes 115. As shown in FIG. 8, ball channel 139 does not define scoring holes. Instead, ball channel 139 defines a path to catch basin 141.

In the example shown in FIGS. 1-3, 6, and 8, first scoring region 148 defines five scoring holes and second scoring region 133 defines five scoring holes as well. However, one scoring regions could define a different number of scoring holes than the other scoring region. Further, each scoring region may define additional or few scoring holes than the five depicted in the figures.

The reader can see in FIG. 8 that each scoring hole 115 is associated with a scoring points value indicated by scoring hole points indicators 132 on first floor 109. In the present example, the five scoring holes in the first scoring region are associated with a scoring points value of 2, 3, 3, 4, and 5. However, other examples have different scoring points values associated with the scoring holes.

In the present example, the scoring hole point values in second scoring region 133 are a mirror image of the scoring hole point values in first scoring region 148. In other examples, however, the scoring hole point values in the second scoring region do not mirror the scoring hole point values in the first scoring region and instead are a unique arrangement of scoring hole point values. In examples where the scoring hole point values differ between the first and second scoring regions, users may strategically attempt to direct the golf ball with their putts to the scoring region with more advantageous point values.

As shown in the figures, the scoring points value in the scoring regions increases the farther from the median of putting golf apparatus the scoring wells are located. In golf games, the goal is typically to incur fewer points rather than higher point totals like in other games. The scoring holes farther from the median of putting game apparatus 100 are associated with higher (less preferred) point values because they represent less skillful putts in the sense that the putts deviate farther from the median. Of course, the game could be configured differently such that putts towards one side or the other were the objective and associated with lower (more preferred) points.

The number of scoring holes and scoring hole points indicators in the putting game apparatus may be selected to meet the needs of a given application. The reader should appreciate that the number of scoring holes and scoring hole points indicators may be different in other examples than is shown in the figures. For instance, some putting game apparatus examples include additional or fewer scoring holes and scoring hole points indicators than described in the present example.

The size and shape of the scoring holes may be varied as needed for a given application. In some examples, the scoring holes is larger or smaller relative to the other components than depicted in the figures.

Catch Basin

With reference to FIGS. 1-3, 6, and 8, first frame 102 defines catch basin 141 in the longitudinal space between bottom sidewall 140 and first lower wall 114 and second lower wall 135. Catch basin 141 is accessible from second frame 103 via ball channel 139 extending from second frame 103 between first scoring region 148 and second scoring region 133.

The reader can see in FIGS. 1-3, 7 and 8 that golf ball 116 reaching ball channel 139 can occur directly when a user successfully putts golf ball into target hole 106 and golf ball 116 travels down target hole path 147 between scatter fields 120. Thus, the best score (a lower score is better than a higher score) may be achieved when a user skillfully directs a ball up ramp 107 into target hole 106.

Directing golf ball 116 into target hole 106 improves the chances that golf ball 116 will follow target hole path 147 between scatter fields 120 and reach catch basin 141 via ball channel 139 rather than golf ball 116 being directed into one of the scoring regions of scoring tray 112. The scoring regions of scoring tray 112 are associated with higher (less preferred) point values. The scoring tray point values are higher because the scoring regions are laterally spaced from the median of putting game apparatus 100 and thus represent deviations from a "true" putt down the middle of putting game apparatus 100.

Catch basin 141 is disposed at a lower elevation than second frame 103 and scoring tray 112, which causes catch basin 141 to be where golf ball 116 most often comes to rest if golf ball 116 does not come to rest within a scoring well 152 defined by scoring tray 112 above catch basin 141.

The reader can see in FIGS. 2, 3, 6, and 8 that first floor 109 includes catch basin points indicator 142 located in catch basin 141. Catch basin points indicator 142 designates gameplay points associated with golf ball 116 coming to rest in catch basin 141.

Since catch basin 141 is where golf ball 116 typically comes to rest if a user successfully putts golf ball 116 into target hole 106, the gameplay points associated with golf ball 116 coming to rest in catch basin 141 are the lowest (best) possible. In the example shown in FIGS. 2, 3, 6, and 8, catch basin points indicator 142 designates one point for a golf ball coming to rest within catch basin 141. In comparison, the point values associated with a ball coming to rest in a scoring well 152 defined by scoring tray 152 range from two to five.

The number of catch basins in the putting game apparatus may be selected to meet the needs of a given application. The reader should appreciate that the number of catch basins may be different in other examples than is shown in the figures. For instance, some putting game apparatus examples include additional or fewer catch basins than described in the present example.

The size and shape of the catch basin may be varied as needed for a given application. In some examples, the catch basin is larger or smaller relative to the other components than depicted in the figures.

Second Frame

Second frame 103 functions to direct golf ball 116 towards first frame 102 after golf ball 116 is putt up ramp 107 and over planar member 105. The reader can see in FIGS. 1-3, 7, and 8 that second frame 103 defines different travel paths for golf ball 116, which serve to direct golf ball 116 to different scoring regions in first frame 102.

As depicted in FIGS. 1-8, second frame 103 is connected to first frame 102. In particular, second frame 103 is pivotally connected to first frame 102. As shown in FIGS. 1-4, and 8, second frame 103 pivots to a position adjacent to first frame 102 in play configuration 123. With reference to FIGS. 5 and 6, second frame 103 pivots to a compact position overlying first frame 102 in stowed configuration 122.

Figure 2:
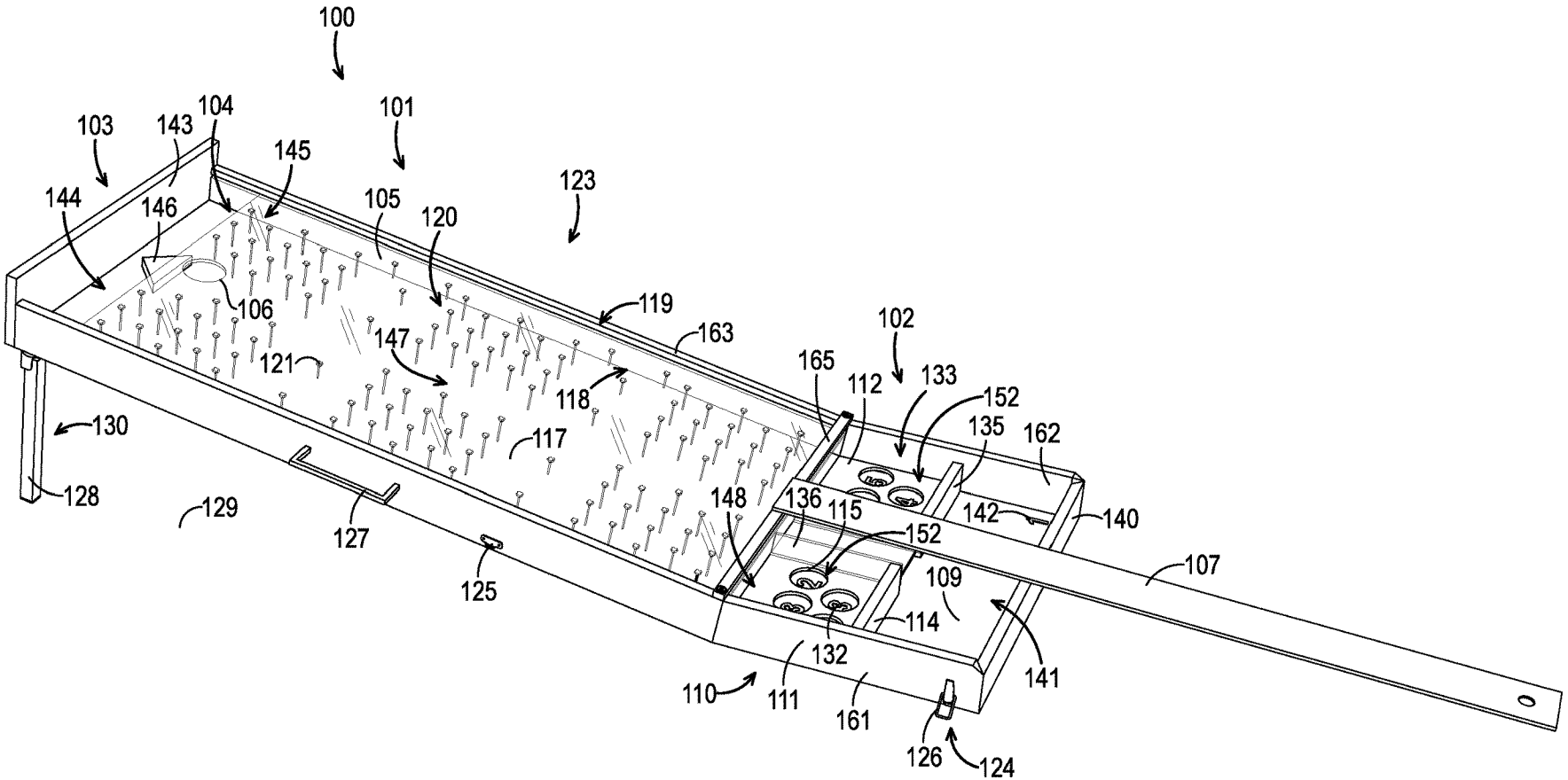
FIG. 2 is a perspective view of the putting game apparatus shown in FIG. 1
Figure 4:
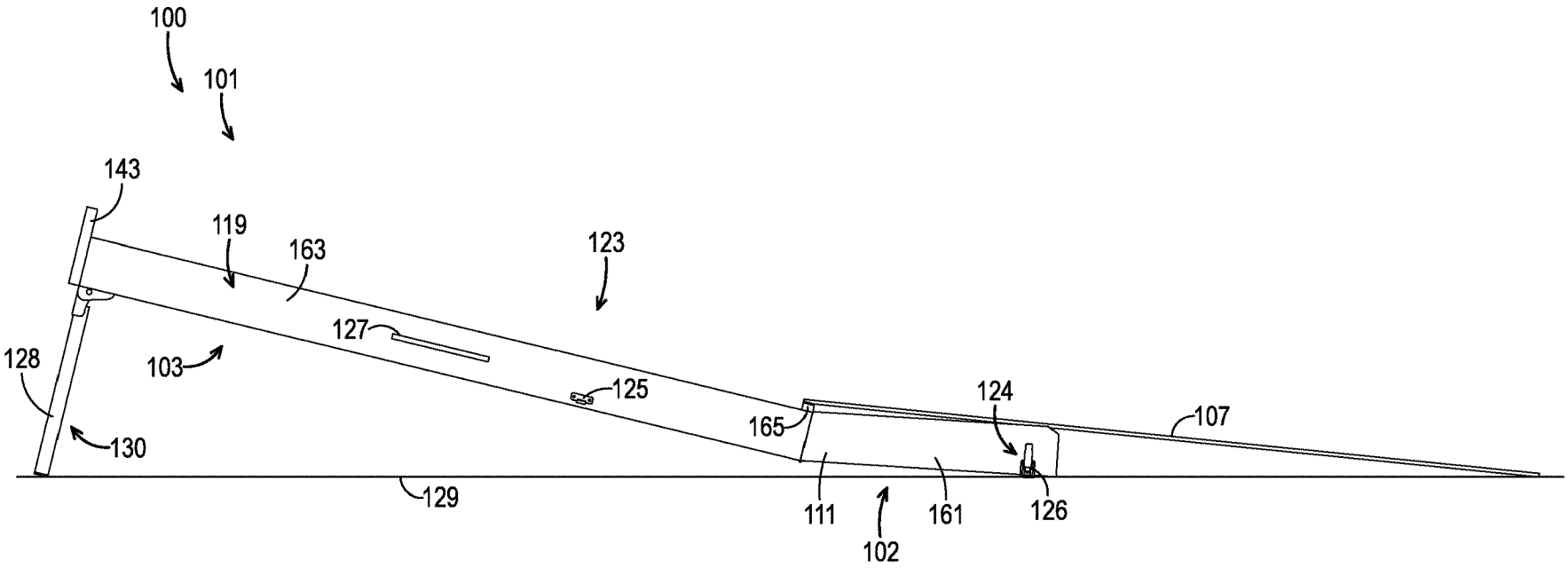
FIG. 4 is a side elevation view of the putting game apparatus shown in FIG. 1 in a play configuration.

As shown in FIGS. 2 and 4, second frame 103 is disposed in a sloped orientation when supported by legs 128. The high end of second frame 103 in the sloped orientation is opposite first frame 102 and the low end of second frame 103 in the sloped orientation is proximate first frame 102. The sloped orientation of second frame 103 causes golf ball 116 to roll towards first frame 102 when golf ball enters second frame 103 near the top of second frame 103.

The reader can see in FIGS. 1-3, 7, and 8 that second frame 103 includes a second floor 117, second sidewalls 119, a scatter field 120, a diverter 146, and a handle 127. The components of second frame 103 are discussed further below.

Second Floor

Second floor 117 provides a rolling surface on which golf ball 116 travels through second frame 103. Further, second floor 117 and second sidewalls 119 and cooperate to contain golf ball 116 within second frame 103. Second sidewalls 119, scatter field 120, and diverter 146 are supported on second floor 117.

As depicted in FIGS. 1-3, second floor 117 includes a second periphery 118. A bottom end 170 of second floor 117 is disposed proximate first frame 102 at a low end of second frame 103 when second frame 103 is in the sloped orientation.

Second Sidewalls

Second sidewalls 119 and second floor 117 cooperate to contain golf ball 116 within second frame 103. As shown in FIGS. 1-3, second sidewalls 119 extend vertically from second periphery 118.

In the example shown in FIGS. 1-8, second sidewalls 119 includes lateral sidewalls 163 and a top sidewall 143. In the sloped orientation, top sidewall 143 is vertically above a bottom end 170 of second floor 117.

The second sidewalls may be any currently known or later developed type of wall. Various wall types exist and could be used in place of the second sidewalls shown in the figures. In addition to the types of walls existing currently, it is contemplated that the putting game apparatuses described herein could incorporate new types of walls developed in the future.

The number of second sidewalls in the putting game apparatus may be selected to meet the needs of a given application. The reader should appreciate that the number of second sidewalls may be different in other examples than is shown in the figures. For instance, some putting game apparatus examples include additional or fewer second sidewalls than described in the present example.

The size and shape of the second sidewalls may be varied as needed for a given application. In some examples, the second sidewalls are larger or smaller relative to the other components than depicted in the figures.

Scatter Field

Scatter field 120 functions to cause golf ball 116 to entertainingly bounce around chaotically as it travels through second frame 103. Scatter field 120 imparts apparent randomness to the gameplay methods to increase the excitement and replay value of putting game apparatus 100.

The reader can see in FIGS. 1-3, 6, and 8 that scatter field 120 includes a plurality of scatter members 121 extending from second floor 117. In the present example, the scatter members are composed of wood golf tees. However, the scatter members may be composed of any currently known or later developed material suitable for spike or peg applications. Suitable materials include metals, polymers, ceramics, wood, and composite materials.

The scatter members may be any currently known or later developed type of peg. Various peg types exist and could be used in place of the scatter members shown in the figures. In addition to the types of pegs existing currently, it is contemplated that the putting game apparatuses described herein could incorporate new types of pegs developed in the future.

The size and shape of the scatter members may be varied as needed for a given application. In some examples, the scatter members are larger or smaller relative to the other components than depicted in the figures.

The number of scatter members in the putting game apparatus may be selected to meet the needs of a given application. The reader should appreciate that the number of scatter members may be different in other examples than is shown in the figures. For instance, some putting game apparatus examples include additional or fewer scatter members than described in the present example.

As depicted in FIGS. 1-3 and 7, scatter field 120 defines a scatter field boundary 145 proximate top sidewall 143. In the present example, scatter field boundary 145 is a laterally extending, substantially straight edge where the plurality of scatter members 121 terminate. However, the shape of the scatter field boundary may vary in different examples.

With reference to FIGS. 1-3 and 7, scatter field 120 defines a target hole path 147 free of scatter members 121. Target hole path 147 extends from below target hole 106 to ball channel 139 of first frame 102. Golf ball 116 traveling down target hole path 147 will most often travel through ball channel 139 into catch basin 141, where the lowest (most preferred) point total for a round is scored.

The reader can appreciate that players will strive to putt golf ball 116 through target hole 106 to improve the chances that golf ball 116 will avoid scatter field 120 and travel down target hole path 147 to ultimately reach catch basin 141 for the lowest score possible. When a player misses target hole 106 with his or her putt, golf ball 116 most often will enter scatter field 120 and be directed to one of the higher point scoring wells 152 defined in scoring tray 112. In some instances, however, golf ball 116 may enter scatter field 120 and bounce out of scatter field 120 into target hole path 147 given the inherent variability of golf ball 116 engaging scatter members 121.

As shown in the figures, scatter field 120 defines two laterally spaced scatter field regions. However, the number of scatter field regions may be different in other examples than is shown in the figures. For instance, some scatter field examples include additional or fewer scatter field regions than described in the present example.

The scatter field may be any currently known or later developed type of obstacle course. Various obstacle course types exist and could be used in place of the scatter field shown in the figures. In addition to the types of obstacle courses existing currently, it is contemplated that the putting game apparatuses described herein could incorporate new types of obstacle courses developed in the future.

Diverter

With reference to FIG. 7, diverter 146 is configured to direct golf ball 116 towards different lateral sides of second frame 103. Directing golf ball 116 towards lateral sides of second frame 103 typically causes golf ball 116 to enter scatter field 120 and to thereafter enter one of the higher (less preferred) scoring regions of first frame 102. Of note, diverter 146 functions to block golf ball 116 from entering target hole path 147 when golf ball 116 enters second frame 103 through entrance gap 144.

The reader can see in FIGS. 1-3 and 7 that diverter 146 is mounted to second floor 117 proximate scatter field boundary 145. As shown in FIGS. 1-3 and 7, diverter 146 is disposed closer to top sidewall 143 than target hole 106. As a result, golf ball 116 will not interact with diverter 146 when golf ball 116 enters second frame 103 through target hole 106 below diverter 146.

When golf ball 116 enters second frame 103 through entrance gap 144 higher up the slope of second frame 103, golf ball 116 may interact with diverter 146 or may pass beside it. In either case, golf ball 116 will typically enter scatter field 120 when entering second frame 103 through entrance gap 144. For example, golf ball 116 will roll down second floor 117 and may enter scatter field 120 by passing laterally beside diverter 146 or by contacting diverter 146 and being directed laterally towards scatter field 120 by diverter 146.

The diverter may be any currently known or later developed type of guide. Various guide types exist and could be used in place of the diverter shown in the figures. In addition to the types of guides existing currently, it is contemplated that the putting game apparatuses described herein could incorporate new types of guides developed in the future.

The number of diverters in the putting game apparatus may be selected to meet the needs of a given application. The reader should appreciate that the number of diverters may be different in other examples than is shown in the figures. For instance, some putting game apparatus examples include additional or fewer diverters than described in the present example.

In the present example, diverter 146 has a triangular shape. However, the size and shape of the diverter may be varied as needed for a given application. In some examples, the diverter is larger or smaller relative to the other components than depicted in the figures.

Handle

With reference to FIGS. 5 and 6, handle 127 enables putting game apparatus 100 to be carried when case 101 is in stowed configuration 122. Handle 127 is mounted to a lateral sidewall of second sidewalls 119, but could be mounted elsewhere on second frame 103.

The handle may be any currently known or later developed type of handle. Various handle types exist and could be used in place of the handle shown in the figures. In addition to the types of handles existing currently, it is contemplated that the putting game apparatuses described herein could incorporate new types of handles developed in the future.

The number of handles in the putting game apparatus may be selected to meet the needs of a given application. The reader should appreciate that the number of handles may be different in other examples than is shown in the figures. For instance, some putting game apparatus examples include additional or fewer handles than described in the present example.

As shown in the FIGS. 1-3, 6 and 7, handle 127 has a C-shape with 90 degree bends. However, the size and shape of the handle may be varied as needed for a given application. In some examples, the handle is curved, L-shaped, or T-shaped. The handle may be larger or smaller relative to the other components than depicted in the figures.

In the present example, the handle is composed of metal. However, the handle may be composed of any currently known or later developed material suitable for handle applications. Suitable materials include metals, polymers, ceramics, wood, and composite materials.

Planar Member

Planar member 104 provides a putting surface 105 for golf ball 116 to travel upon after golf ball 116 travels up ramp 107. Further, planar member 104 defines openings through which golf ball 116 can pass through to reach second frame 103; namely target hole 106 and entrance gap 144.

Planar member 104 is supported on second frame 103. In particular, planar member 104 overlies and is parallel to second floor 117. As shown in in FIGS. 1-3 and 7, ramp 107 exits onto planar member 104 such that golf ball 116 may roll from ramp 107 onto planar member 104 when putt by a user.

The reader can see in FIGS. 1-3 and 7 that planar member 104 includes a putting surface 105 facing away from second frame 103. Putting surface 105 enables golf ball 116 to roll from ramp 107 above second frame 103 when putt by a user up ramp 107.

The size and shape of the planar member may be varied as needed for a given application. In some examples, the planar member is larger or smaller relative to the other components than depicted in the figures.

In the example shown in the figures, planar member 104 is transparent. Planar member 104 being transparent allows a user to see golf ball 116 roll along second floor 117 through scatter field 120 or along target hole path 147. The user being able to see golf ball 116 travel through second frame 103 increases the excitement and fun of putting gameplay methods enabled by putting game apparatus 100.

In the present example, the planar member is composed of plexiglass. However, the planar member may be composed of any currently known or later developed material suitable for see-through cover applications.

As shown in FIGS. 1-3 and 7, planar member 104 defines a target hole 106 extending through planar member 104. Target hole 106 provides an opening through which golf ball 116 may travel from putting surface 105 of planar member 104 to second floor 117 of second frame 103. In particular, golf ball 116 passing through target hole 106 is more likely to avoid scatter field 120 and higher point scoring regions of scoring tray 112 by traveling along target hole path 147 to ultimately reach catch basin 141 with the lowest possible point value awarded for the putt.

The size and shape of the target hole may be varied as needed for a given application. In some examples, the target hole is larger or smaller relative to the other components than depicted in the figures. The number of target holes in the putting game apparatus may be different in other examples than is shown in the figures. For instance, some putting game apparatus examples include additional or fewer target holes than described in the present example.

As further depicted in FIGS. 1-3 and 7, planar member 104 is longitudinally spaced from a top sidewall 143 of second sidewalls 119 to define an entrance gap 144. As shown in FIGS. 1-3 and 7, entrance gap 144 is disposed longitudinally between scatter field boundary 145 and top sidewall 143. Diverter 146 is disposed underneath entrance gap 144 and will typically direct golf ball 116 passing through entrance gap 144 towards scatter field 120 if golf ball 116 does not enter scatter field 120 directly.

With reference to FIGS. 1-3 and 7, entrance gap 144 is at least as large as a diameter of golf ball 116. Entrance gap 144 being larger than golf ball 116 allows golf ball 116 to pass through entrance gap 144 to the space between planar member 104 and second floor 117.

Ramp

The role of ramp 107 is to provide an initial path for putting golf ball 116 towards planar member 104 and second frame 103 as part of a putting gameplay method utilizing putting game apparatus 100. In particular, with reference to FIG. 1, ramp 107 defines a tee shot path 108 onto putting surface 105 of planar member 104.

The reader can seen in FIG. 1 that ramp 107 is relatively narrow, which makes putting golf ball 116 along ramp 107 to planar member 104 successfully a challenging endeavor. However, the size and shape of the ramp may be varied as needed for a given application, such as to make the putting challenge provided by the ramp easier or harder. In some examples, the ramp is larger or smaller relative to the other components than depicted in the figures.

As depicted in FIGS. 1-4, ramp 107 is selectively disposed over first frame 102 in play configuration 123. The reader can see that ramp 107 rests on a cross member 165 spanning across lateral sidewalls of second sidewalls 119. A top end of ramp 107 rests on putting surface 105. As such, tee shot path 108 exits onto putting surface 105.

As shown in FIG. 6, ramp 107 is selectively secured between first frame 102 and second frame 103 when case 101 is in stowed configuration 122. Second frame 103 and ramp 107 are complementarily configured to have similar longitudinal dimensions such that ramp 107 is covered by second frame 103 in stowed configuration 122. First frame 102 overlying ramp 107 in stowed configuration 122 helps to secure ramp 107 in place.

The number of ramps in the putting game apparatus may be selected to meet the needs of a given application. The reader should appreciate that the number of ramps may be different in other examples than is shown in the figures. For instance, some putting game apparatus examples include additional or fewer ramps than described in the present example.

The ramp may be any currently known or later developed type of ramp. Various ramp types exist and could be used in place of the ramp shown in the figures. In addition to the types of ramps existing currently, it is contemplated that the putting game apparatuses described herein could incorporate new types of ramps developed in the future.

In the present example, the ramp is composed of wood. However, the ramp may be composed of any currently known or later developed material suitable for ramp applications. Suitable materials include metals, polymers, ceramics, wood, and composite materials.

Latch Assembly

As depicted in FIG. 5, latch assembly 124 is configured to selectively secure first frame 102 to second frame 103 in stowed configuration 122. Securing first frame 102 to second frame 103 in stowed configuration 122 with latch assembly 124 facilitates transporting and storing putting game apparatus 100.

The reader can see in FIGS. 2, 4, 5, and 8 that latch assembly 124 is mounted on case 101. In particular, latch assembly 124 includes components mounted to sidewalls of both first frame 102 and second frame 103. With reference to FIGS. 2, 4, 5, and 8, latch assembly 124 includes a catch 125 and a latch arm 126. The components of latch assembly 114 are discussed further below.

The number of latch assemblies in the putting game apparatus may be selected to meet the needs of a given application. The reader should appreciate that the number of latch assemblies may be different in other examples than is shown in the figures. For instance, some putting game apparatus examples include additional or fewer latch assemblies than described in the present example.

The latch assembly may be any currently known or later developed type of latch assembly. Various latch assembly types exist and could be used in place of the latch assembly shown in the figures. In addition to the types of latch assemblies existing currently, it is contemplated that the putting game apparatuses described herein could incorporate new types of latch assemblies developed in the future.

Catch

Catch 125 functions to selectively receive and secure latch arm 126. When latch arm 126 is selectively engaged with catch 125, latch assembly 124 secures case 101 in stowed configuration 122.

As shown in FIGS. 2, 4, 5, and 8, catch 125 is secured to second frame 103. In particular, catch 125 is secured to a lateral sidewall of second sidewalls 119. The reader can see in FIG. 8 and others that catch 125 and latch arm 126 are disposed on the same lateral side of case 101.

The catch may be any currently known or later developed type of latch catch. Various latch catch types exist and could be used in place of the catch shown in the figures. In addition to the types of latch catches existing currently, it is contemplated that the putting game apparatuses described herein could incorporate new types of latch catches developed in the future.

The size and shape of the catch may be varied as needed for a given application. In some examples, the catch is larger or smaller relative to the other components than depicted in the figures.

Latch Arm

The reader can see in FIG. 5 that latch arm 126 is configured to selectively engage catch 125 when case 101 is in stowed configuration 122. When latch arm 126 is selectively engaged with catch 125, latch assembly 124 secures case 101 in stowed configuration 122.

As depicted in FIGS. 2, 4, 5, and 8, latch arm 126 is secured to first frame 102. In particular, latch arm 125 secures to first lateral sidewall 161. As shown in FIG. 8, catch 125 and latch arm 126 are disposed on the same lateral side of case 101.

FIG. 8 discloses the particular configuration of latch arm 126 in detail. However, the latch arm may be any currently known or later developed type of latch arm. Various latch arm types exist and could be used in place of the latch arm shown in the figures. In addition to the types of latch arms existing currently, it is contemplated that the putting game apparatuses described herein could incorporate new types of latch arms developed in the future.

The size and shape of the latch arm may be varied as needed for a given application. In some examples, the latch arm is larger or smaller relative to the other components than depicted in the figures.

Legs

As shown in FIG. 4, legs 128 are configured to selectively support second frame 103 from a support surface 129. With reference to FIGS. 2 and 4-6, legs 128 are disposed underneath second frame 103. The reader can see in FIGS. 2 and 4-6 that legs 128 are pivotally coupled to second frame 103.

As shown in FIGS. 2 and 4-6, legs 128 are configured to pivot between a support configuration 130 and a transport configuration 131. As depicted in FIGS. 5 and 6, legs 128 abut second frame 103 in transport configuration 131. With reference to FIGS. 2 and 4, legs 128 extend transversely from second frame 103 in support configuration 130. The reader can see in FIGS. 5 and 6 that leg 128 and first frame 102 underlie second frame 103 within a perimeter of second frame 103 when legs 128 are in transport configuration 131 and case 101 is in stowed configuration 122.

The size and shape of the legs may be varied as needed for a given application. In some examples, the legs are larger or smaller relative to the other components than depicted in the figures.

The present example of putting game apparatus 100 includes two legs 128. However, the number of legs in the putting game apparatus may be selected to meet the needs of a given application. The reader should appreciate that the number of legs may be different in other examples than is shown in the figures. For instance, some putting game apparatus examples include additional or fewer legs than described in the present example.

In the present example, the legs are composed of metal. However, the legs may be composed of any currently known or later developed material suitable for support applications. Suitable materials include metals, polymers, ceramics, wood, and composite materials.

The legs may be any currently known or later developed type of support leg. Various support leg types exist and could be used in place of the legs shown in the figures. In addition to the types of support legs existing currently, it is contemplated that the putting game apparatuses described herein could incorporate new types of support legs developed in the future.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A putting game apparatus, comprising:
a case including:
a first frame,
a second frame connected to the first frame, and
a planar member overlying the second frame, the planar member including a putting surface facing away from the second frame and defining a target hole extending through the planar member; and
a ramp selectively disposed over the first frame and defining a tee shot path onto the putting surface of the planar member;
wherein:
the first frame includes:
a first floor including a first periphery,
first sidewalls extending from the first periphery, and
a scoring tray supported by a first lateral sidewall of the first sidewalls and a first lower wall extending transverse from the first lateral sidewall, the scoring tray being spaced above the first floor and defining an array of scoring holes complementarily configured with a golf ball;
the second frame includes:
a second floor including a second periphery,
second sidewalls extending from the second periphery, and
a scatter field disposed on the second floor, the scatter field including a plurality of scatter members extending from the second floor.

2. The putting game apparatus of claim 1, wherein:
the first frame is pivotally coupled to the second frame;
the case is configured to pivot between a stowed configuration and a play configuration;
the first frame pivots to a position underlying the second frame in the stowed configuration; and
the first frame pivots to a position adjacent to the second frame in the play configuration.

3. The putting game apparatus of claim 2, further comprising a latch assembly mounted on the case and configured to secure the first frame to the second frame in the stowed configuration.

4. The putting game apparatus of claim 3, wherein the latch assembly includes:
a catch secured to the second frame; and
a latch arm secured to the first frame and configured to selectively engage the catch when the case is in the stowed configuration.

5. The putting game apparatus of claim 2, wherein:
the second frame includes a handle; and
the putting game apparatus is configured to be portable and carried by the handle when the case is in the stowed configuration.

6. The putting game apparatus of claim 2, wherein the ramp is selectively secured between the first frame and the second frame when the case is in the stowed configuration.

7. The putting game apparatus of claim 2, further comprising a leg disposed underneath the second frame and configured to selectively support the second frame from a support surface.

8. The putting game apparatus of claim 7, wherein the leg is pivotally coupled to the second frame.

9. The putting game apparatus of claim 8, wherein:
the leg is configured to pivot between a support configuration and a transport configuration;
the leg extends transversely from the second frame in the support configuration; and
the leg abuts the second frame in the transport configuration.

10. The putting game apparatus of claim 7, wherein the leg and the first frame underlie the second frame within a perimeter of the second frame when the leg is in the transport configuration and the case is in the stowed configuration.

11. The putting game apparatus of claim 1, wherein the first floor includes a scoring hole points indicator underneath each scoring hole in the array of scoring holes designating gameplay points associated with a golf ball being received in a given scoring hole.

12. The putting game apparatus of claim 1, wherein the scoring tray is spaced from the first floor a distance less than a height of the golf ball to retain the golf ball within a given scoring hole when the golf ball enters the given scoring hole.

13. The putting game apparatus of claim 1, wherein:
the scoring tray includes a first scoring region and a second scoring region laterally spaced from the first scoring region; and
the second scoring region is adjacent to a second lateral sidewall of the first sidewalls opposite the first lateral sidewall and to a second lower wall extending transverse from the second lateral sidewall.

14. The putting game apparatus of claim 13, wherein:
the first scoring region is laterally bounded by a first barrier wall extending longitudinally from the first lower wall and separating the first scoring region from a median of the first frame; and
the second scoring region is laterally bounded by a second barrier wall extending longitudinally from the second lower wall and separating the second scoring region from the median of the first frame.

15. The putting game apparatus of claim 14, wherein the second barrier wall is laterally spaced from the first barrier wall to define a ball channel between them.

16. The putting game apparatus of claim 15, wherein:
the first lower wall and the second lower wall are longitudinally spaced from a bottom sidewall of the first sidewalls;
the first frame defines a catch basin in the longitudinal space between the bottom sidewall and the first lower wall and the second lower wall; and
the ball channel communicates with the catch basin.

17. The putting game apparatus of claim 16, wherein the first floor includes a catch basin points indicator designating gameplay points associated with the golf ball being received in the catch basin.

18. The putting game apparatus of claim 1, wherein:
the planar member is longitudinally spaced from a top sidewall of the second sidewalls to define an entrance gap;
the entrance gap is at least as large as a diameter of the golf ball to allow the golf ball to pass through the entrance gap to the space between the planar member and the second floor.

19. The putting game apparatus of claim 18, wherein:
the second frame is disposed in a sloped orientation where the top sidewall is vertically above a bottom end of the second floor longitudinally opposite the top sidewall;
the scatter field defines a scatter field boundary proximate the top sidewall;
the entrance gap is disposed longitudinally between the scatter field boundary and the top sidewall.

20. The putting game apparatus of claim 19, wherein:

the second frame includes a diverter mounted to the second floor proximate the scatter field boundary;

the diverter is disposed closer to the top sidewall than the target hole;

the scatter field defines a target hole path free of scatter members extending from below the target hole to the first frame; and the diverter is configured to direct the golf ball towards different lateral sides of the second frame and to block the golf ball from entering the target hole path.

* * * * *